US010526825B2

(12) United States Patent
Harder et al.

(10) Patent No.: US 10,526,825 B2
(45) Date of Patent: Jan. 7, 2020

(54) CABINET ASSEMBLY

(71) Applicant: NewAge Products, Inc., Vaughan (CA)

(72) Inventors: Mitch Harder, Toronto (CA); Robert Vandenham, North York (CA)

(73) Assignee: NewAge Products, Inc., Vaughan (CA)

( * ) Notice: Subject to any disclaimer, the term of this patent is extended or adjusted under 35 U.S.C. 154(b) by 0 days.

(21) Appl. No.: 15/952,902

(22) Filed: Apr. 13, 2018

(65) Prior Publication Data

US 2018/0298654 A1 Oct. 18, 2018

Related U.S. Application Data

(60) Provisional application No. 62/485,651, filed on Apr. 14, 2017.

(51) Int. Cl.
*E05C 9/04* (2006.01)
*A47B 96/20* (2006.01)
(Continued)

(52) U.S. Cl.
CPC ..... *E05C 9/04* (2013.01); *A47B 96/20* (2013.01); *E05C 1/004* (2013.01); *E05C 1/06* (2013.01);
(Continued)

(58) Field of Classification Search
CPC ..... E05C 9/04; E05C 9/20; E05C 9/22; E05C 9/185; E05C 9/041; E05C 9/042;
(Continued)

(56) References Cited

U.S. PATENT DOCUMENTS 1,590,441 A * 6/1926 Piggot ..... E05B 65/025 292/124
1,642,501 A * 9/1927 Knell ..... E05B 65/025 292/156

(Continued)

FOREIGN PATENT DOCUMENTS

| | | |
|---|---|---|
| CA | 2 562 430 C | 4/2007 |
| CN | 106013971 A | 10/2016 |
| WO | 2016/022177 A1 | 2/2016 |

OTHER PUBLICATIONS

English language abstract for CN106013971A extracted from espacenet.com database on Jul. 30, 2018, 1 page.

*Primary Examiner* — Daniel J Troy
*Assistant Examiner* — Timothy M Ayres
(74) *Attorney, Agent, or Firm* — Howard & Howard Attorneys PLLC

(57) ABSTRACT

A cabinet assembly includes a cabinet having a cabinet body and a door assembly pivotably coupled to the cabinet body. The door assembly includes a door body having an outer panel, a first and second panel, and an inner panel that define an interior door cavity. The inner panel includes a fixed panel and a snap-in cover panel. The cabinet assembly includes a locking assembly at least partially contained within the interior door cavity and having a first lock rod, a latch and a locking mechanism each coupled to the first lock rod. The locking mechanism configured to selectively lock and unlock the door assembly to the cabinet body when the door assembly is in a closed position. The latch is configured to engage the flange when the locking mechanism is in the locked position to prevent movement of the door assembly from the closed to open position.

20 Claims, 12 Drawing Sheets

(51) Int. Cl.
*E05C 1/00* (2006.01)
*E05C 9/20* (2006.01)
*E05C 1/06* (2006.01)

(52) U.S. Cl.
CPC ..... *E05C 9/20* (2013.01); *E05Y 2600/46* (2013.01); *E05Y 2900/208* (2013.01)

(58) Field of Classification Search
CPC ..... E05C 9/043; E05C 9/045; E05C 9/047; E05C 9/048; E05C 9/1858; E05C 1/06; E05C 1/004; A47B 96/20; E05Y 2600/46; E05Y 2900/208; E05B 65/02
USPC ..... 312/217
See application file for complete search history.

(56) References Cited

U.S. PATENT DOCUMENTS 1,677,278 A * 7/1928 Foehrenbach ..... E05B 65/025 292/120
1,865,205 A * 6/1932 Palmquist ..... E05C 9/045 292/2
2,852,926 A * 9/1958 Chervenka ..... E05B 65/025 70/141
3,722,236 A * 3/1973 Zelenko ..... B65F 1/1426 292/161
4,998,757 A * 3/1991 Ramsauer ..... E05B 13/10 292/160
5,171,047 A 12/1992 Korb et al.
5,290,077 A 3/1994 Fleming
5,632,166 A * 5/1997 Wiersma ..... E05C 9/045 292/337
5,992,098 A 11/1999 Flider et al.
6,729,701 B2 * 5/2004 Carter ..... A62C 2/242 292/166
7,726,751 B2 * 6/2010 Bergmann ..... E05B 65/02 312/222
8,167,386 B2 * 5/2012 Bergesch ..... E05B 65/02 292/32
8,960,815 B2 2/2015 Karandikar et al.
2008/0143121 A1 * 6/2008 Blasen ..... E05C 9/004 292/92
2011/0001404 A1 1/2011 Lear et al.
2014/0097731 A1 * 4/2014 Grela ..... B25H 3/00 312/237

* cited by examiner

CABINET ASSEMBLY

CROSS REFERENCE TO RELATED APPLICATIONS

The present invention claims priority to U.S. provisional application 62/485,651, filed Apr. 14, 2017, the disclosure of which is herein incorporated by reference.

FIELD OF THE DISCLOSURE

The present invention relates, generally, to a cabinet assembly including a door locking mechanism and a cover panel.

DESCRIPTION OF THE RELATED ART

Cabinet assemblies known in the art generally include a back panel, side panels, and end panels coupled to a top and bottom. Cabinet assemblies may be hung on a wall, rest on a shelf, rest on a floor surface, or be otherwise supported. When the cabinet assembly is supported on a floor surface, the cabinet assembly generally includes a support assembly coupled to the base to space the base from the floor surface.

At least some known cabinet assemblies include door locking mechanisms that are attached to the interior surface of a cabinet door and exposed to the interior cabinet volume of the cabinet. Because known locking mechanisms are exposed to the interior cabinet volume, the locking mechanisms may come in contact with the items being stored in the cabinet, causing damage to the stored items and/or the locking mechanism as the locking mechanism is operated to lock and unlock the cabinet door.

Accordingly, improvements in existing cabinet are needed to provide locking mechanisms that are not exposed to the interior of the cabinet assemblies. The present invention is directed to satisfying these needs.

SUMMARY OF THE INVENTION

A cabinet assembly includes a cabinet having a cabinet body and a door assembly pivotably coupled to the cabinet body and moveable between an open and closed position. The door assembly includes a door body having an outer panel, a first and second panel, and an inner panel that define an interior door cavity. The inner panel includes a fixed panel and a snap-in cover panel. The cabinet assembly includes a locking assembly at least partially contained within the interior door cavity and having a first lock rod, a latch and a locking mechanism each coupled to the first lock rod, with the locking mechanism configured to selectively lock and unlock the door assembly to the cabinet body when the door assembly is in the closed position. The latch is configured to engage the flange when the locking mechanism is in the locked position to prevent movement of the door assembly.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Figure 1:
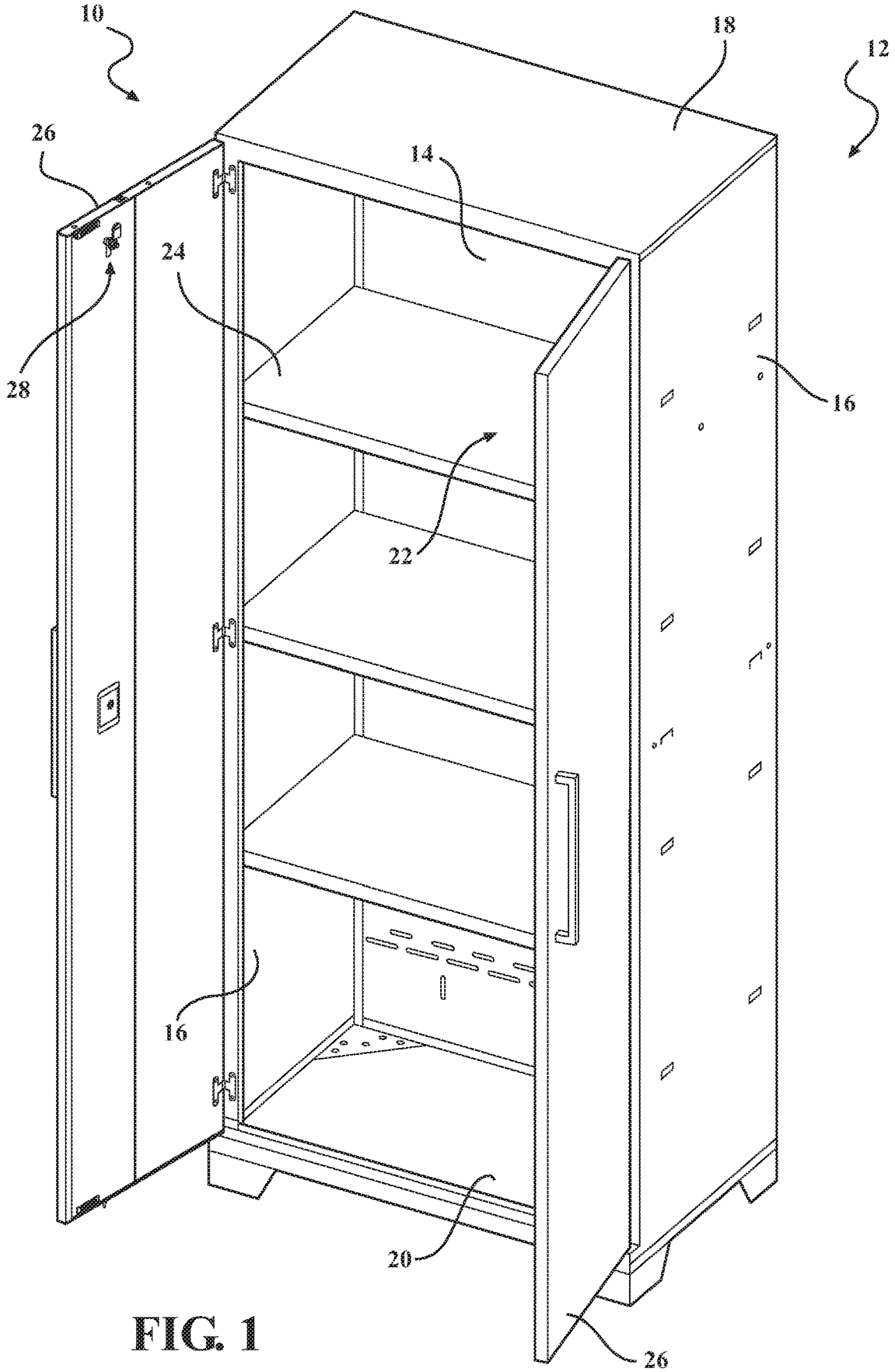
FIG. 1 is a perspective view of a cabinet assembly.
Figure 2:
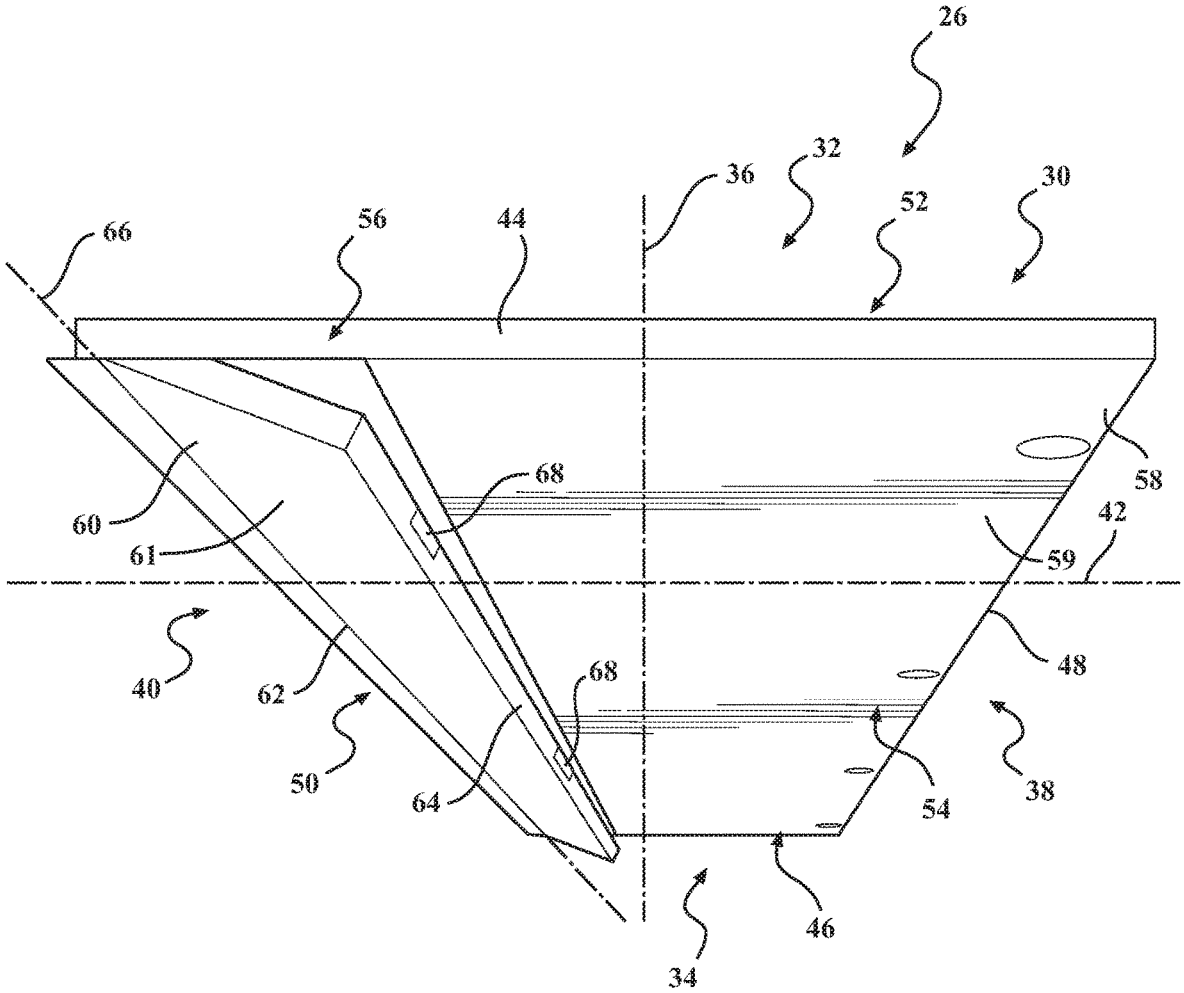
FIG. 2 is a perspective view of a door assembly that may be used with the cabinet assembly shown in FIG. 1, according to an embodiment of the present invention.
Figure 3:
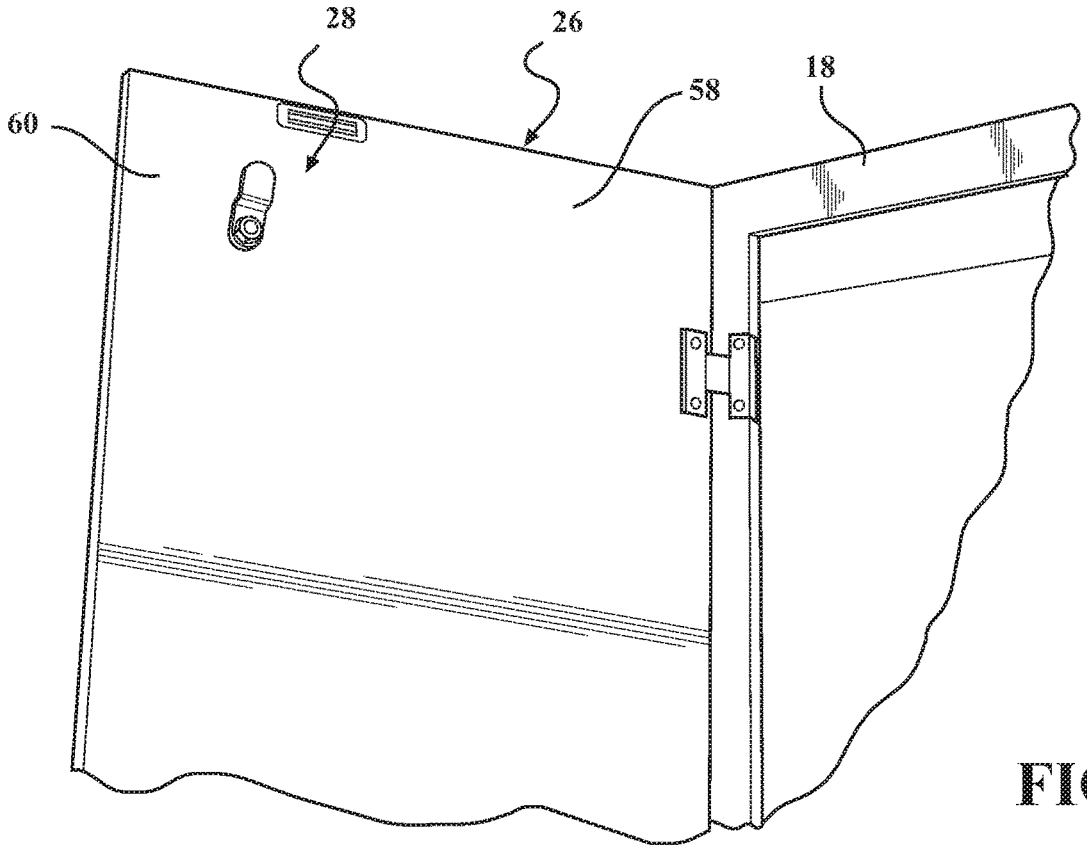
FIGS. 3 and 4 are perspective views of the door assembly shown in FIG. 2 including a locking assembly, according to an embodiment of the present invention.
Figure 4:
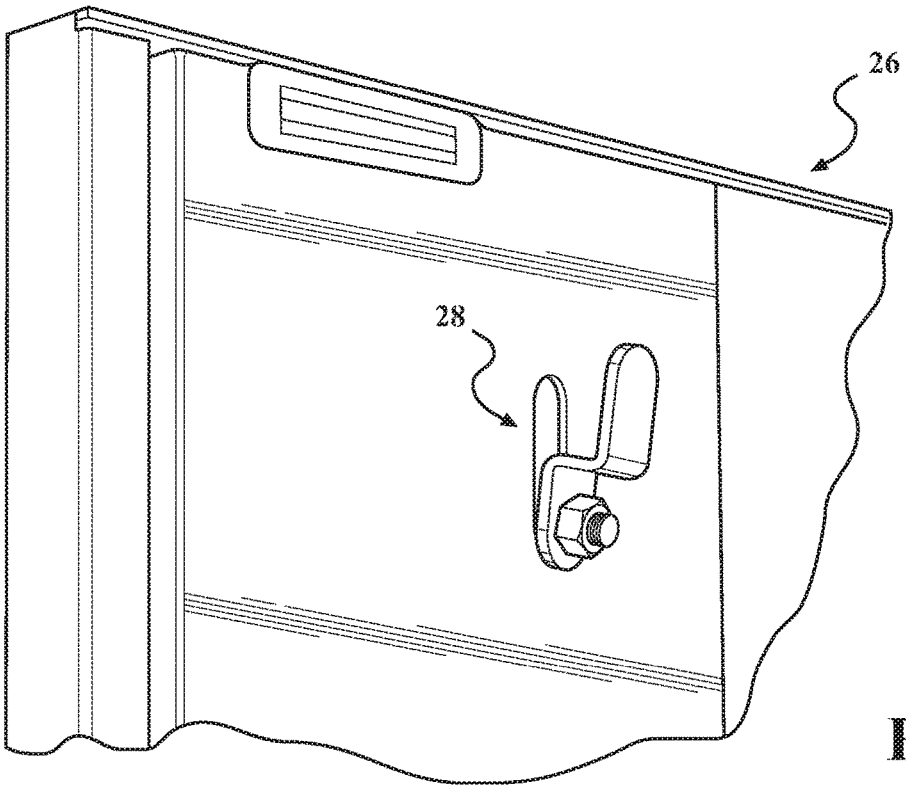
Figure 6:
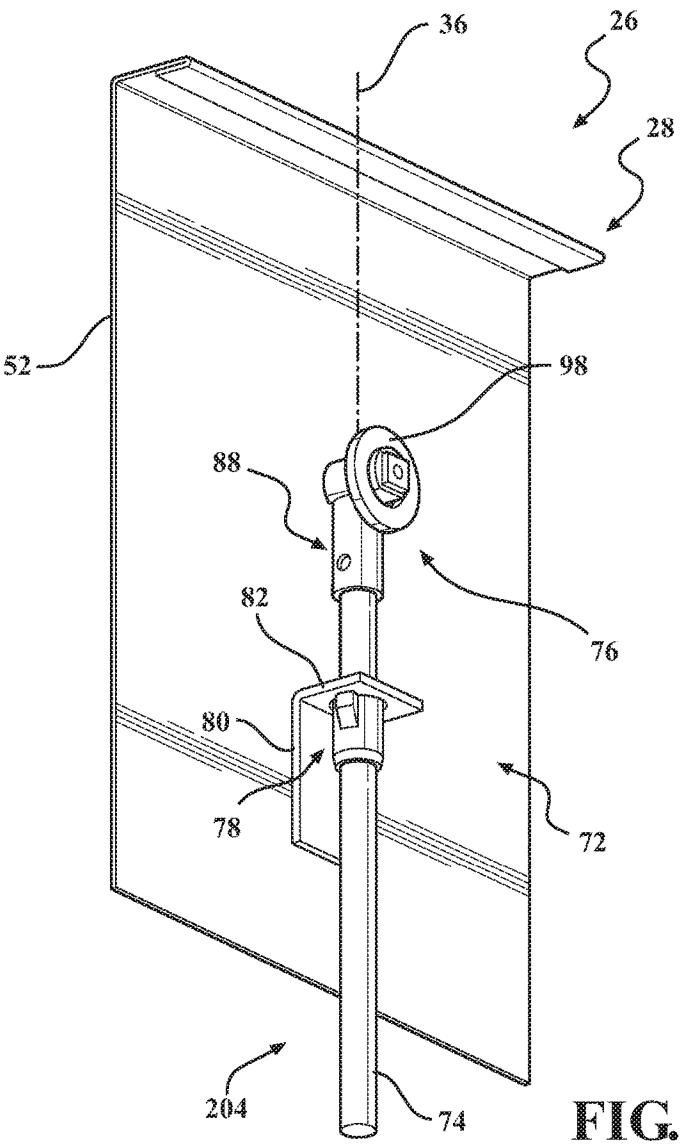
FIGS. 5-10 are schematic views of the locking assembly shown in FIGS. 3-4.
Figure 5:
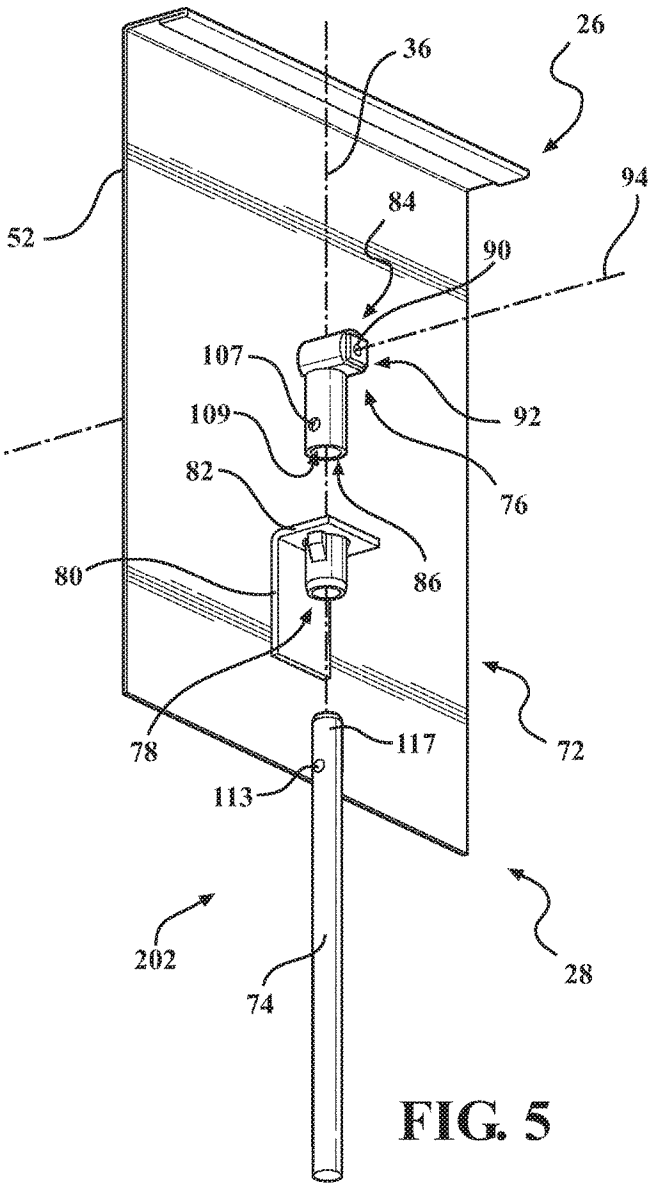
Figure 8:
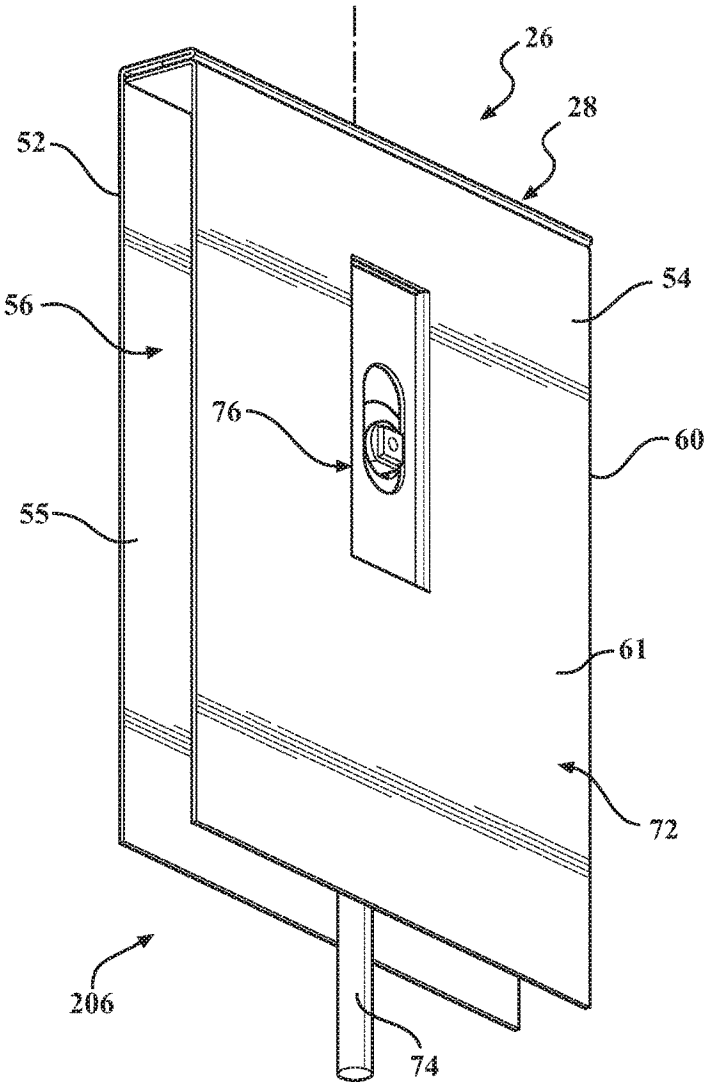
Figure 7:
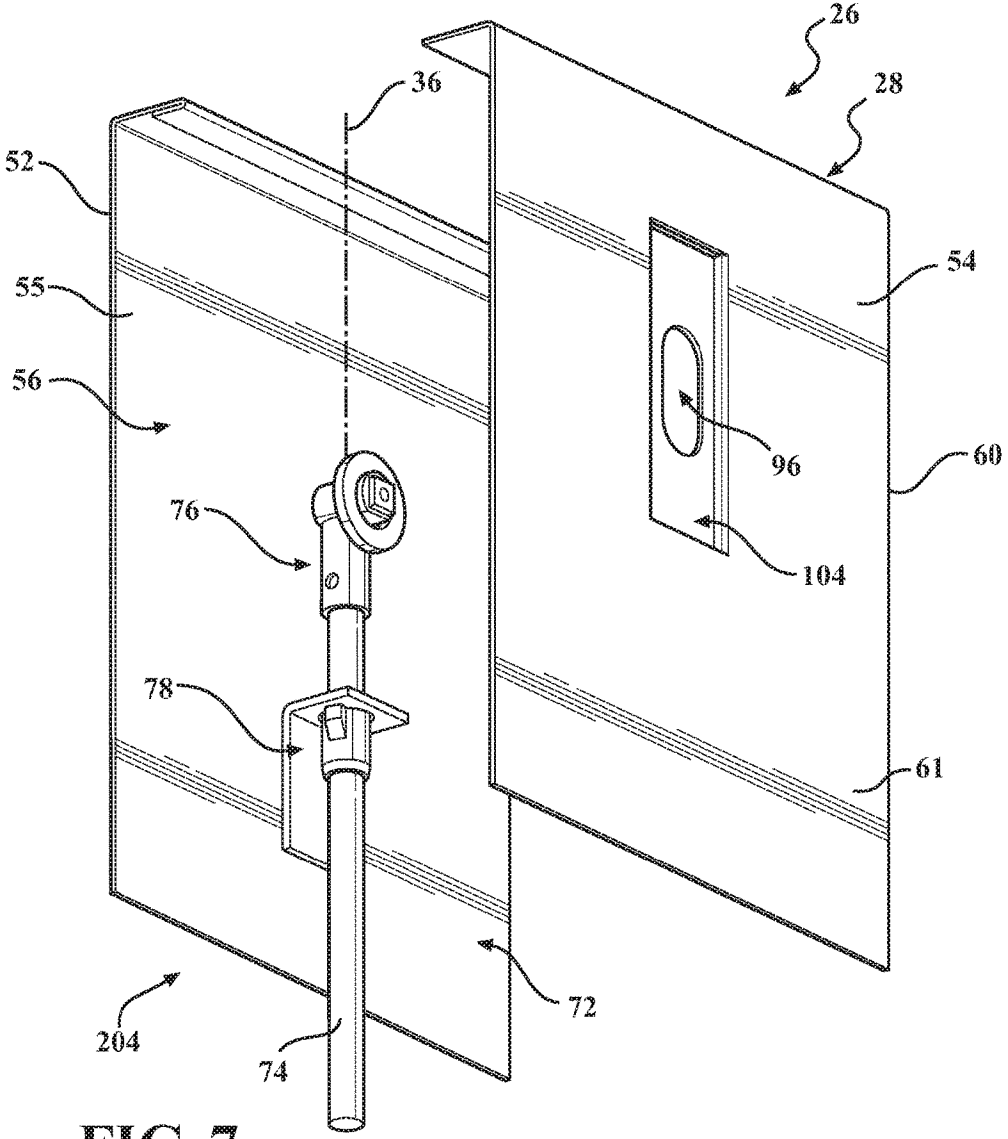
Figure 10:
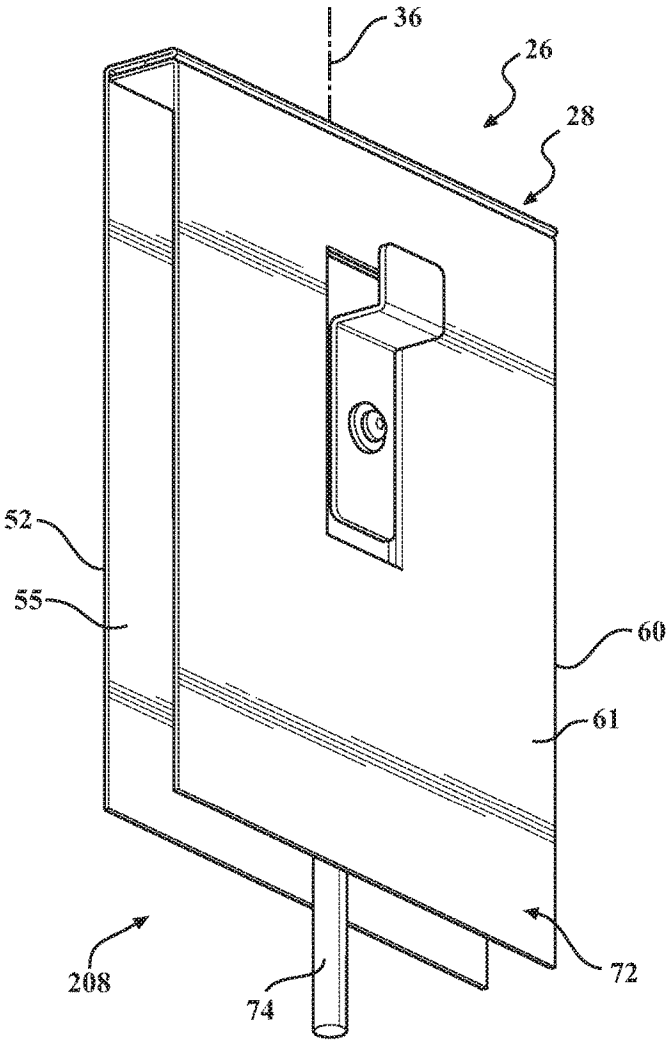
Figure 9:
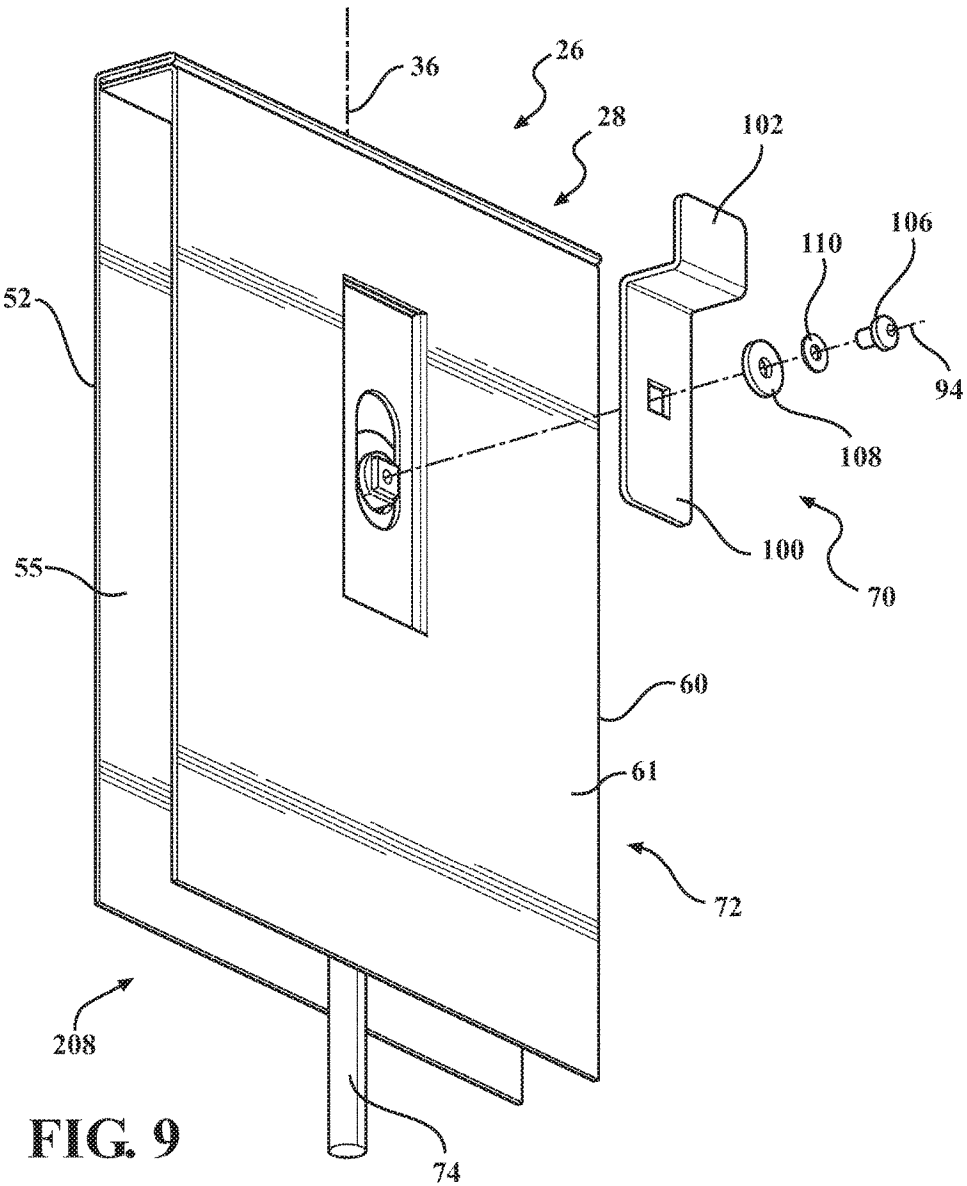
Figure 11:
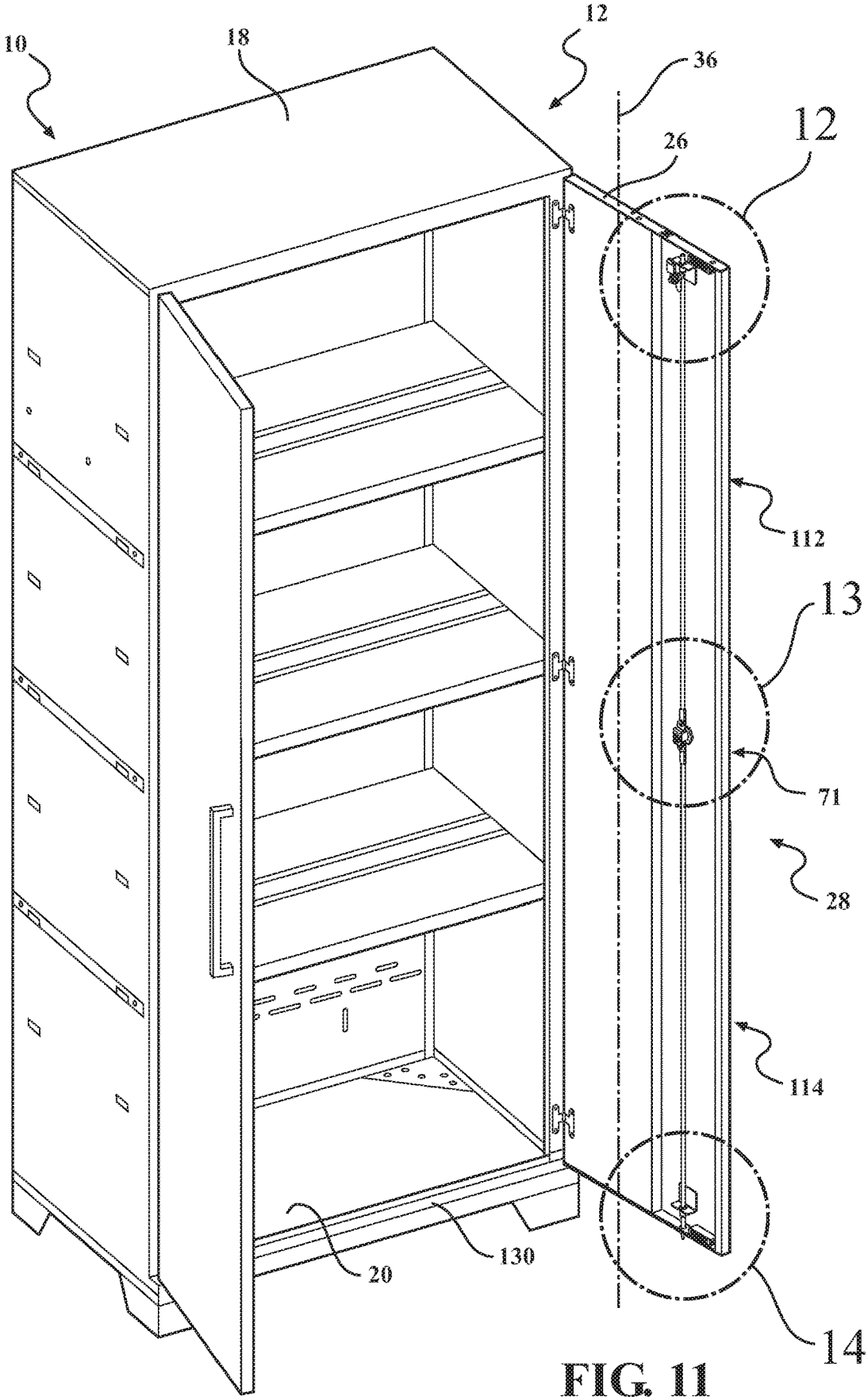
FIG. 11 is another perspective view of the cabinet assembly shown in FIG. 1, according to an embodiment of the present invention.

With reference to the Figures, wherein like numerals indicate like parts throughout the several views, a cabinet assembly 10 is generally shown in FIG. 1. Generally, the cabinet assembly 10 includes a cabinet body 12 that includes a back wall 14, a pair of opposing sidewalls 16 coupled to the back wall 14, a top wall 18, and an opposing bottom wall 20. The top wall 18 and the bottom wall 20 are coupled to the back wall 14 and to the pair of sidewalls 16 to define an interior volume 22 of the cabinet assembly 10. In one embodiment the cabinet assembly 10 may additionally include shelves 24 or drawers disposed within the interior volume 22 and coupled to one of the back wall 14, and sidewalls 16.

In the illustrated embodiment, the cabinet assembly 10 also includes at least one door assembly 26 that is pivotably coupled to a sidewall 16 and movable between an open position to provide access to the interior volume 22 and a closed position to enclose the interior volume 22 of the cabinet assembly 10. In one embodiment, the door assembly 26 includes a locking assembly 28 that is configured to operate between a locked position and an unlocked position. In the locked position, the locking assembly 28 contacts the cabinet body 12 to secure the door assembly 26 to the cabinet body 12 to facilitate preventing a movement of the door assembly 26 to enclose the interior volume 22 of the cabinet assembly 10. In the unlocked position, the locking assembly 28 does not contact the cabinet body 12 and allows the door assembly 26 to move with respect to the cabinet body 12 to allow a user to access the interior volume 22 of the cabinet assembly 10.

In general, the present invention provides a means to lock a frameless cabinet. Known cabinets have a frame that allows a locking rod to extend straight out of the top or bottom of the door into the frame. The present invention includes a cabinet that has a frameless top and a locking rod that extends through the door face at the top and connect to a latch that could lock onto the frame behind the door. It should be noted that this rod and latch configuration of the present invention could be used on both the top and bottom of the door for a fully frameless cabinet. In one embodiment, the cabinet may include a bottom frame so the locking rod could extend and lock into this frame. In another embodiment, the lock assembly may include a latch only on the bottom of the door in the case the cabinet had a top frame but no bottom frame.

In addition, the present invention also includes a snap-in cover as a means for allowing access to the interior door cavity of the double wall welded door to allow the lock assembly to be assembled into a double wall welded door prior to the installation of the snap-in cover. The snap-in cover, after installation, provides a further means for containing the lock assembly such that it is not exposed with items stored in the interior cabinet volume distinct from the interior door cavity by separating the interior door cavity from the interior volume of the cabinet door assembly. For example, if the door was fully welded shut on both sides there would be no way to install the locking mechanism. Another alternate to the snap-in cover design could be to affix this cover panel with screws, bolts, or rivets, but the appearance would not be as aesthetically pleasing due to the visibility of these fasteners.

Referring to FIGS. 2 and 15-17, in the illustrated embodiment, the door assembly 26 includes a door body 30 that extends between a top end 32 and a bottom end 34 along a longitudinal axis 36, and extends between a first side edge 38 and an opposite second side edge 40 along a transverse axis 42 that is perpendicular to the longitudinal axis 36.

The door body 30 includes a top panel 44, a bottom panel 46, a first side panel 48, and an opposite second side panel 50. The top panel 44 is orientated substantially parallel to the bottom panel 46. The first side panel 48 and the second side panel 50 are coupled to the top panel 44 and the bottom panel 46 and extend between the top panel 44 and the bottom panel 46 along the longitudinal axis 36. In one embodiment, the first side panel 48 is pivotably coupled to one of the sidewalls 16 to support the door assembly 26 from the sidewall 16. The door body 30 also includes an outer panel 52 and an inner panel 54. The outer panel 52 extends between the top panel 44, the bottom panel 46, and each of the side panels 48 and 50 to form an exterior surface of the cabinet assembly 10. The inner panel 54 extends between the top panel 44, the bottom panel 46, and each of the side panels 48 and 50 to form an interior surface of the cabinet assembly 10 that defines at least a portion of the interior volume 22. The inner panel 54 is spaced a distance from the outer panel 52 such that an interior door cavity 56 is defined between the inner panel 54 and the outer panel 52.

Figure 16:
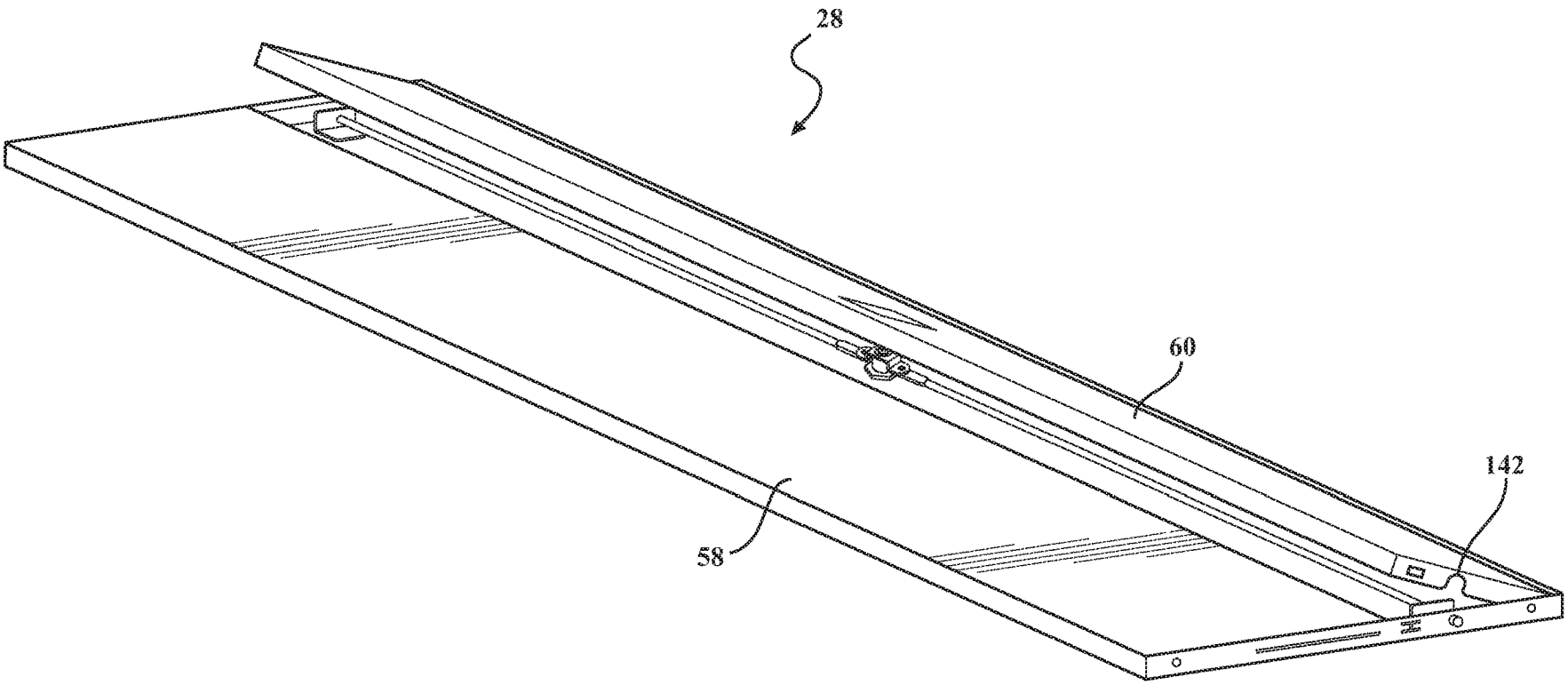

In one embodiment, the inner panel 54 includes a fixed panel 58 and a snap-in cover panel 60. The fixed panel 58 is coupled to the first side panel 48 and extends along the transverse axis 42 towards the snap-in cover panel 60. The snap-in cover panel 60 is positioned between the second side panel 50 and the fixed panel 58. In the illustrated embodiment, the snap-in cover panel 60 includes a first outer edge 62 and an opposite second outer edge 64. The first outer edge 62 includes a stepped outer edge (shown in FIG. 17) that is coupled to an edge of the second side panel 50 along axis 66. During installation, the stepped outer edge is inserted under the outer edge of the second side panel 50. In the illustrated embodiment, the snap-in cover panel 60 includes a plurality of locking clips 68 that coupled to the second outer edge 64 and are spaced along the longitudinal axis 36. Each locking clip 68 includes a clip flange that extends outwardly from the second outer edge 64. The fixed panel 58 includes a plurality of corresponding positioning slots defined along an exterior edge of the fixed panel 58. Each positioning slot is sized and shaped to receive a corresponding clip flange therein to facilitate coupling the snap-in cover panel 60 to the fixed panel 58 such that an outer surface 61 of the snap-in cover panel 60 is substantially flush with an outer surface 59 of the fixed panel 58. Referring to FIG. 16, in one embodiment, the bottom panel 46 and/or the top panel 44 include locking tabs. The snap-in cover panel 60 includes a locking tab cutout that is sized and shaped to receive the locking tabs therein to couple to cover panel 60 to the bottom panel 46 and/or the top panel 44. The locking tabs are bent inward into the locking tab cutout after the snap-in cover panel 60 is installed to fix the snap-in cover panel 60 to the bottom patent 46 and/or top panel 44.

Referring to FIGS. 3-10, in the illustrated embodiment, the door assembly 26 includes the locking assembly 28 to allow a user to selectively lock and unlock the door assembly 26 to the cabinet body 12 when the door assembly is also in the closed position to prevent access to the cabinet interior volume 22. A portion of the locking assembly 28 is positioned within the interior door cavity 56 between the inner panel 54 and the outer panel 52.

In the illustrated embodiment, the locking assembly 28 includes a latch 70, lock rod assembly 72 that is coupled to the latch 70, and a locking mechanism 71 (shown in FIG. 13) that is coupled to the lock rod assembly 72 for moving the latch 70 between the locked position and the unlocked position. The lock rod assembly 72 is positioned within the interior door cavity 56 between the outer panel 52 and the inner panel 54. The latch 70 is coupled to the lock rod assembly 72 and extends outwardly from an inner surface 55 of the inner panel 54. The latch 70 is configured to engage a flange (shown in FIG. 3) extending outwardly from the top wall 18 of the cabinet assembly 10 along the longitudinal axis 36 when the locking mechanism is in the locked position and when the door assembly is in the closed position to prevent movement of the door assembly 26 from the closed position to the open position.

In the illustrated embodiment, the lock rod assembly 72 includes a lock rod 74, an end cap 76, and a guide bushing 78. A support bracket 80 is coupled to an inner surface 55 of the outer panel. The support bracket 80 includes a support flange 82 that extends outwardly from the outer panel 52 and is orientated substantially perpendicular to the inner surface 55 of the outer panel. The support flange 82 includes an opening that is sized and shaped to receive the guide bushing 78 therethrough to couple the guide bushing 78 to the support bracket 80 via a friction fit to support the locking assembly 28 from the outer panel 52. The guide bushing 78 includes an opening that extends therethrough and is sized and shaped to receive the lock rod 74 such that the lock rod 74 is inserted through the guide bushing 78. The end cap 76 includes a body that extends between a first end 84 and a second end 86. A distal end 117 of the lock rod 74 is inserted through a lower opening 109 defined at the second end 86 of the end cap 76 to couple the end cap 76 to the lock rod 74. In certain embodiments, the distal end 117 of the lock rod 74 and the second end 86 of the end cap 76 includes side openings 113, 109, with a cotter pin 88 inserted through these corresponding side openings 107, 113 to facilitate coupling the end cap 76 to the lock rod 74.

In the illustrated embodiment, the end cap 76 includes a support member 90 that includes a substantially planar supporting surface that is orientated substantially parallel with the inner surface 55 of the outer panel. The support member 90 includes a threaded opening 92 that extends along a centerline axis 94 orientated perpendicular to the inner surface 55 of the outer panel. The support member 90 extends through an elongated slot 96 defined through the snap-in cover panel 60. The elongated slot 96 is sized and shaped to allow the support member 90 to move within the elongated slot 96 along the longitudinal axis 36. A washer 98 is positioned around the support member 90 and between an inner surface of the snap-in cover panel 60 and the end cap 76.

The latch 70 is coupled to the end cap 76 such that the snap-in cover panel 60 is positioned between the latch 70 and the end cap 76. In the illustrated embodiment, the latch 70 includes a support flange 100 and an L-shaped locking flange 102 that extends outwardly from the support flange 100. The support flange 100 is orientated substantially parallel with the outer surface 61 of the snap-in cover panel 60. The L-shaped locking flange 102 includes a planar locking surface that is positioned a distance from the snap-in cover panel 60 and is orientated substantially parallel to the outer surface 61 of the snap-in cover panel 60. In one embodiment, the cover panel 60 includes recessed portion 104 defined along the outer surface 61 of the snap-in cover panel 60 that is sized and shaped to receive the support flange 100 such that the support flange 100 is substantially flush with the outer surface 61 of the snap-in cover panel 60. Alternatively, the cover panel 60 may not include the recessed portion 104 such that the support flange 100 is flush with the outer surface 61 of the snap-in cover panel 60.

In the illustrated embodiment, the support flange 100 includes an opening that extends therethrough. The latch 70 includes a threaded locking bolt 106 that extends through the opening of the support flange 100 and into the threaded opening of the support member 90 to couple the support flange 100 to the end cap 76 and to allow the latch 70 and the end cap 76 to move with respect to the snap-in cover panel 60 along the longitudinal axis 36. A spacer 108 and locking washer 110 are positioned between a head of the locking nut 106 and the support flange 100.

Figure 12:
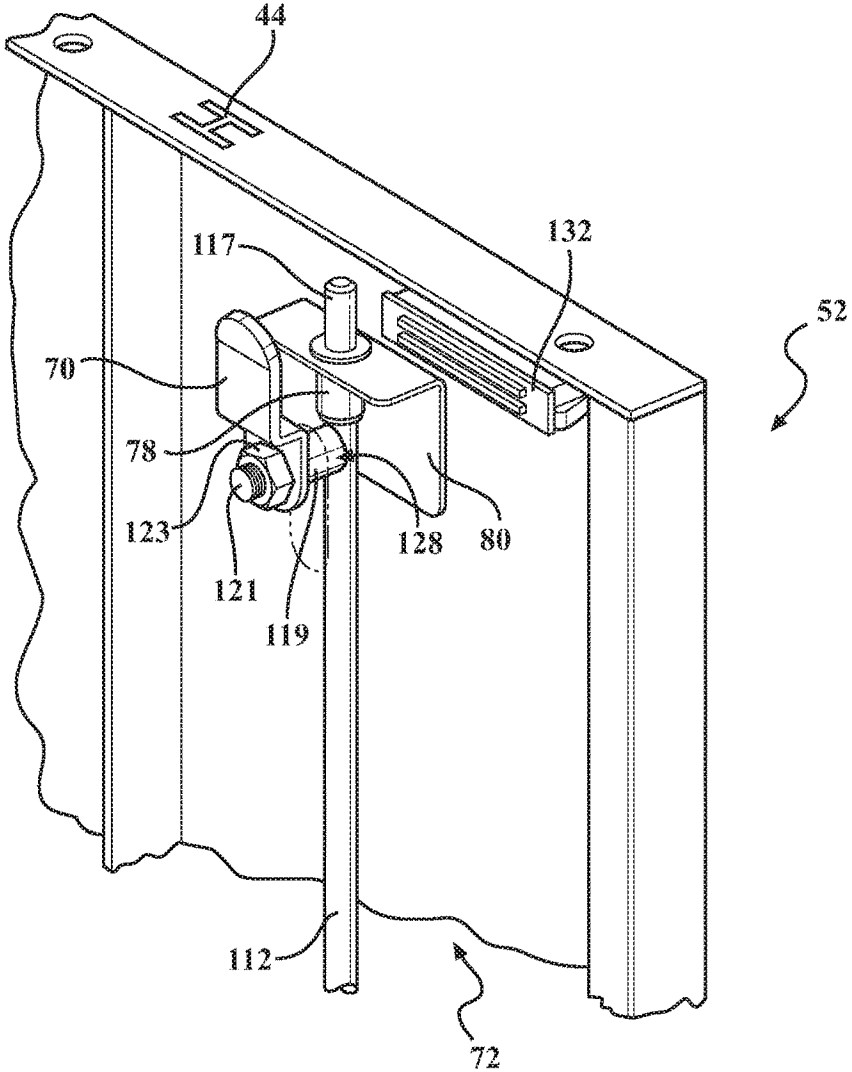
FIG. 12 is a partial schematic view of the locking assembly taken along area 12 shown in FIG. 11.

In one embodiment, as shown in FIG. 12, the lock rod assembly 72 does not include the end cap 76, and lock rod 74 includes a welded peg 119 with a threaded end 121 that extends from the lock rod 74 below the location of the plastic guide bushing 78. The latch 70 is coupled to the lock rod 74 with a single locking nut 123, as the welded peg 119 protrudes through the elongated slot 96 of the snap-in cover panel 60. The threaded end 121 of the welded peg 119 only exists at the end of the welded peg that extends through the snap-in cover panel 60. The welded peg 119 also includes a non-threaded shoulder 125 that prevents the latch 70 from being tightened right up to the outer surface 61 of the snap-in cover panel 60 to allow the latch 70 to slide along the outer surface 61 of the snap-in cover panel 60.

Referring to FIGS. 11-14, in one embodiment, the locking assembly 28 includes a first lock rod 112 and a second lock rod 114. The first lock rod 112 is coupled to the locking mechanism 71 and extends from the locking mechanism 71 towards the top panel 44 along the longitudinal axis 36. The second lock rod 114 is coupled to the locking mechanism 71 and extends from the locking mechanism 71 towards the bottom panel 46 along the longitudinal axis 36.

In the illustrated embodiment, the first lock rod 112 is coupled to the latch 70. In one embodiment, as shown in FIG. 12, the latch 70 is coupled to the first lock rod 112 such that the guide bushing 78 is positioned between the latch 70 and the distal end of the lock rod 112.

Figure 14:
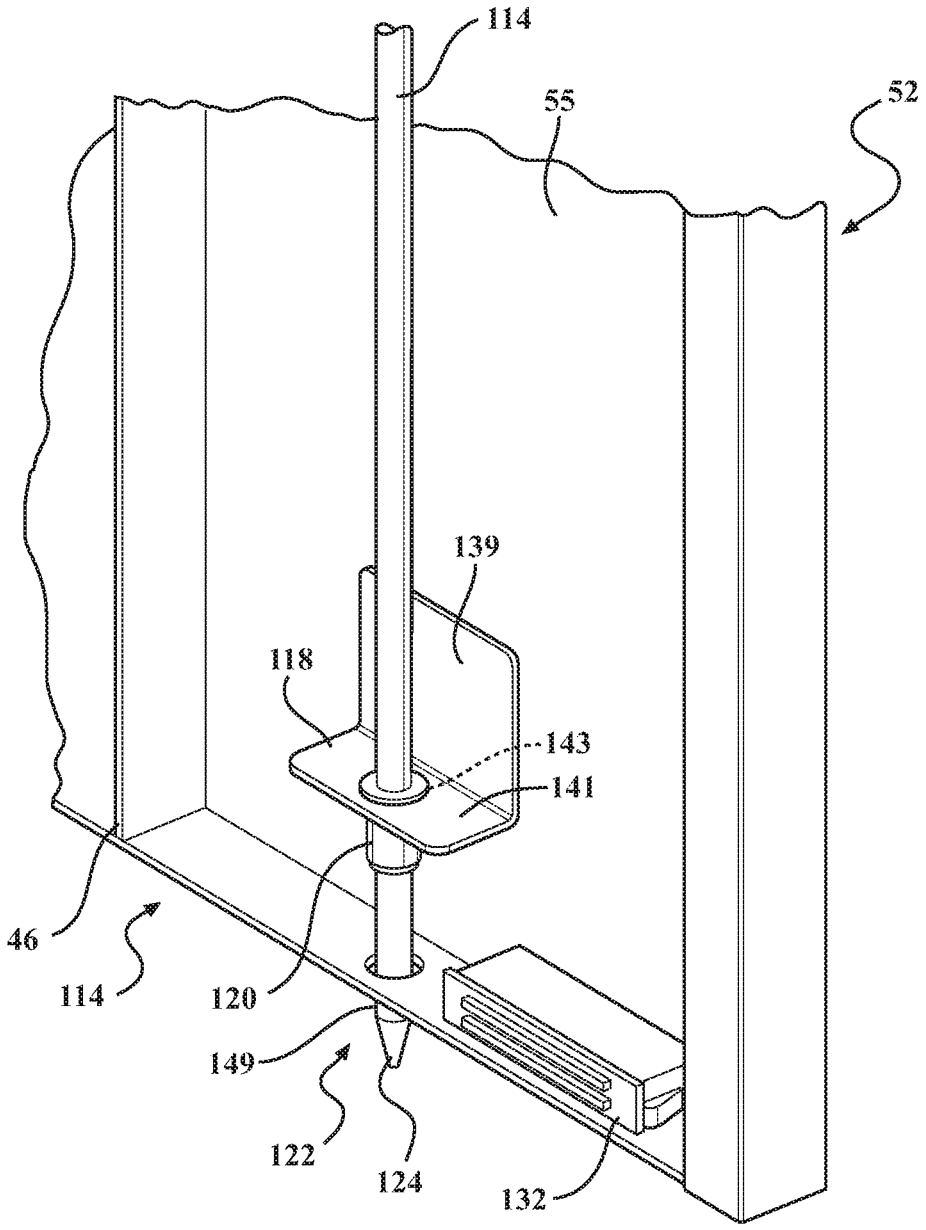
FIG. 14 is a partial schematic view of the locking assembly taken along area 14 shown in FIG. 11.
Figure 15:
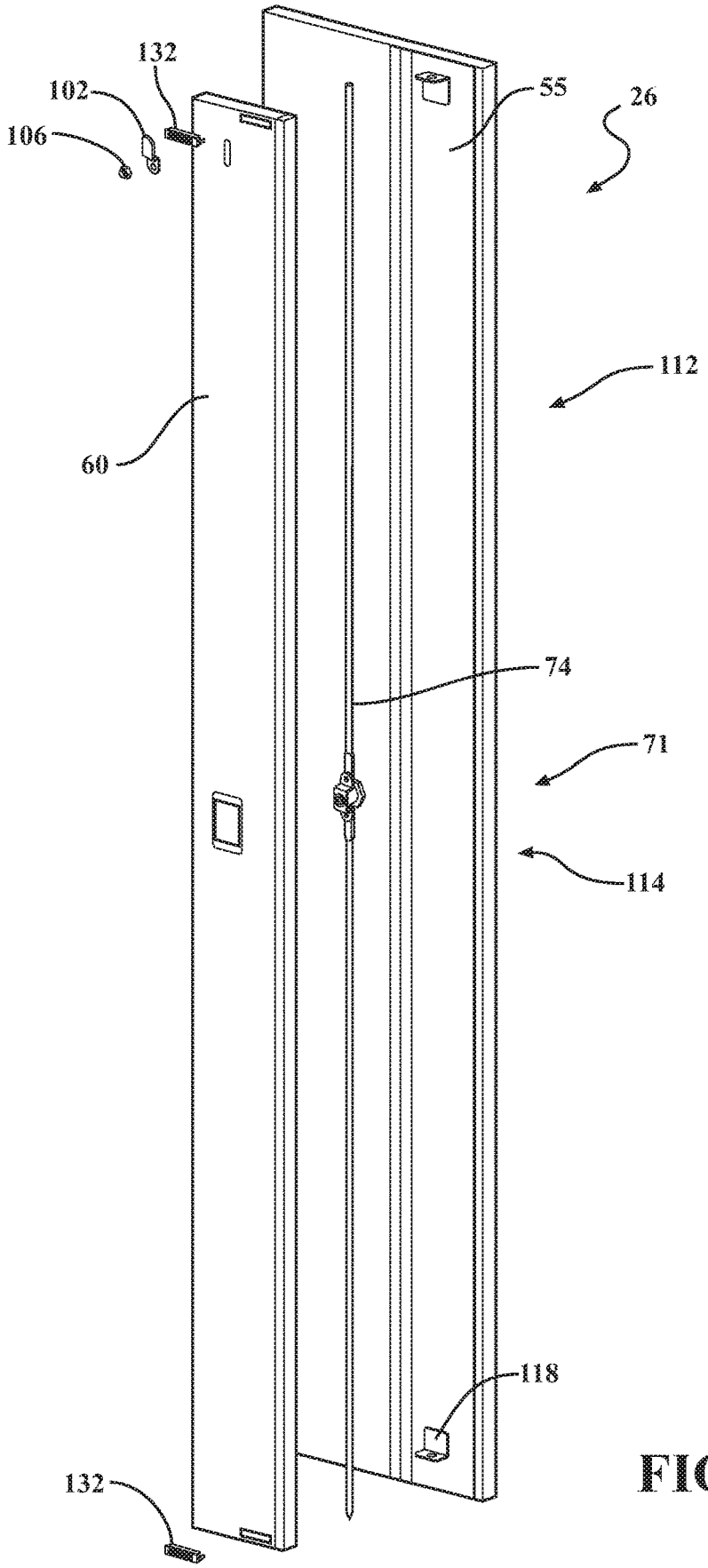
FIGS. 15-17 are perspective views of the door assembly that may be used with the cabinet assembly shown in FIGS. 1 and 12.

Referring to FIG. 14, the second lock rod 114 is coupled to the locking mechanism 71 and extends from the locking mechanism 71 towards the bottom panel 46. A guide bracket 118 includes a support flange portion 139 coupled to the inner surface 55 of the outer panel 52 and includes a free flange portion 141 having an opening 143 that is sized and shaped to receive a sleeve guide 120 therethrough. The sleeve guide 120 is positioned within the opening 143 of the guide bracket 118 such that the sleeve guide 120 is coupled to the guide bracket 118 via a friction fit. The sleeve guide 120 includes a guide opening that extends through the sleeve guide 120 and is sized and shaped to receive the second lock rod 114 therethrough. The bottom panel 46 includes a positioning slot 122 that extends through the bottom panel 46. The positioning slot 122 is sized and shaped to receive a positioning member 124 defined at the distal end 149 of the second lock rod 114 therethrough with the locking assembly 28 in the locked position. As shown in FIG. 16, in one embodiment, the snap-in cover panel 60 includes a lock rod cutout 147 that is sized and shaped to receive the second lock rod 116.

Figure 13:
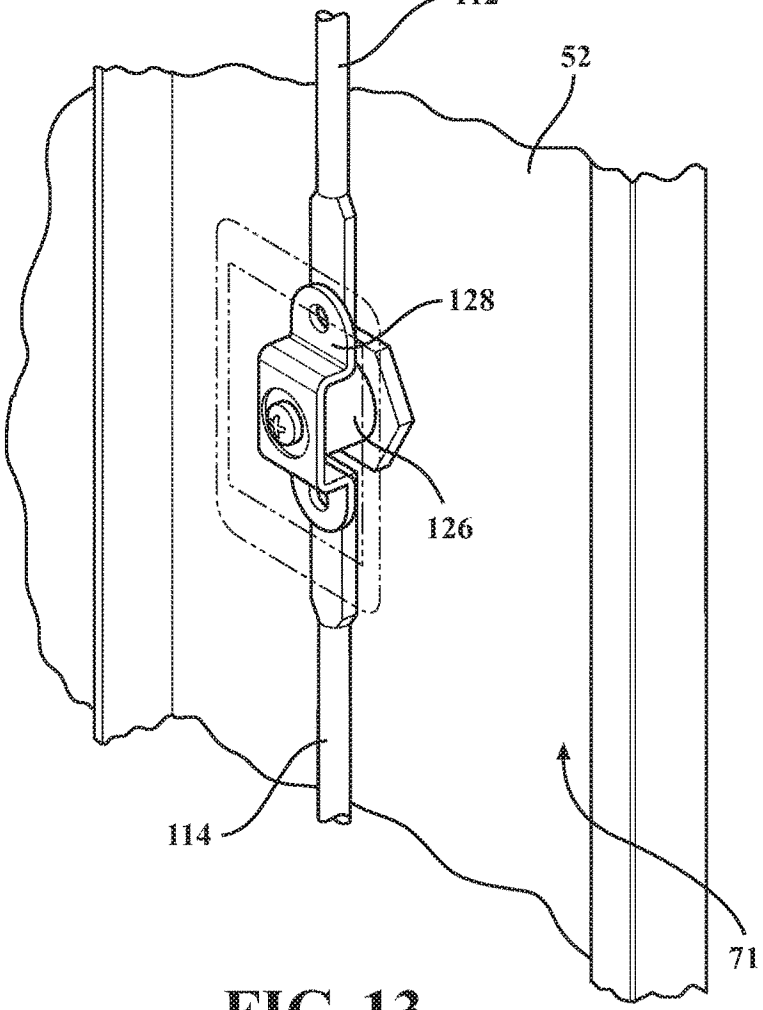
FIG. 13 is a partial schematic view of the locking assembly taken along area 13 shown in FIG. 11.

In one embodiment, as shown in FIG. 13, the locking mechanism 71 includes a lock cylinder 126 that is coupled to the outer panel 52. A cam arm 128 is rotatable coupled to the lock cylinder 126 such that a rotation of the lock cylinder 126 rotates the cam arm 128. A first end of the cam arm 128 is coupled to the first lock rod 112, and an opposite second end of the cam arm 128 is coupled to the second lock rod 114. During operation, the lock cylinder is rotatable through a 90° rotational angle to move the locking assembly 28 between the locked position and the unlocked position. In the locked position, the cam arm 128 is orientated along the longitudinal axis 36 to position the distal end of the second lock rod 114 outwardly from the bottom panel 46 towards the bottom wall 20, and to extend the latch 70 towards the top wall 18. The bottom wall 20 includes a locking rod hole 130 that is sized and shaped to receive the second lock rod 116 therein to prevent movement of the door assembly 26.

Figure 17:
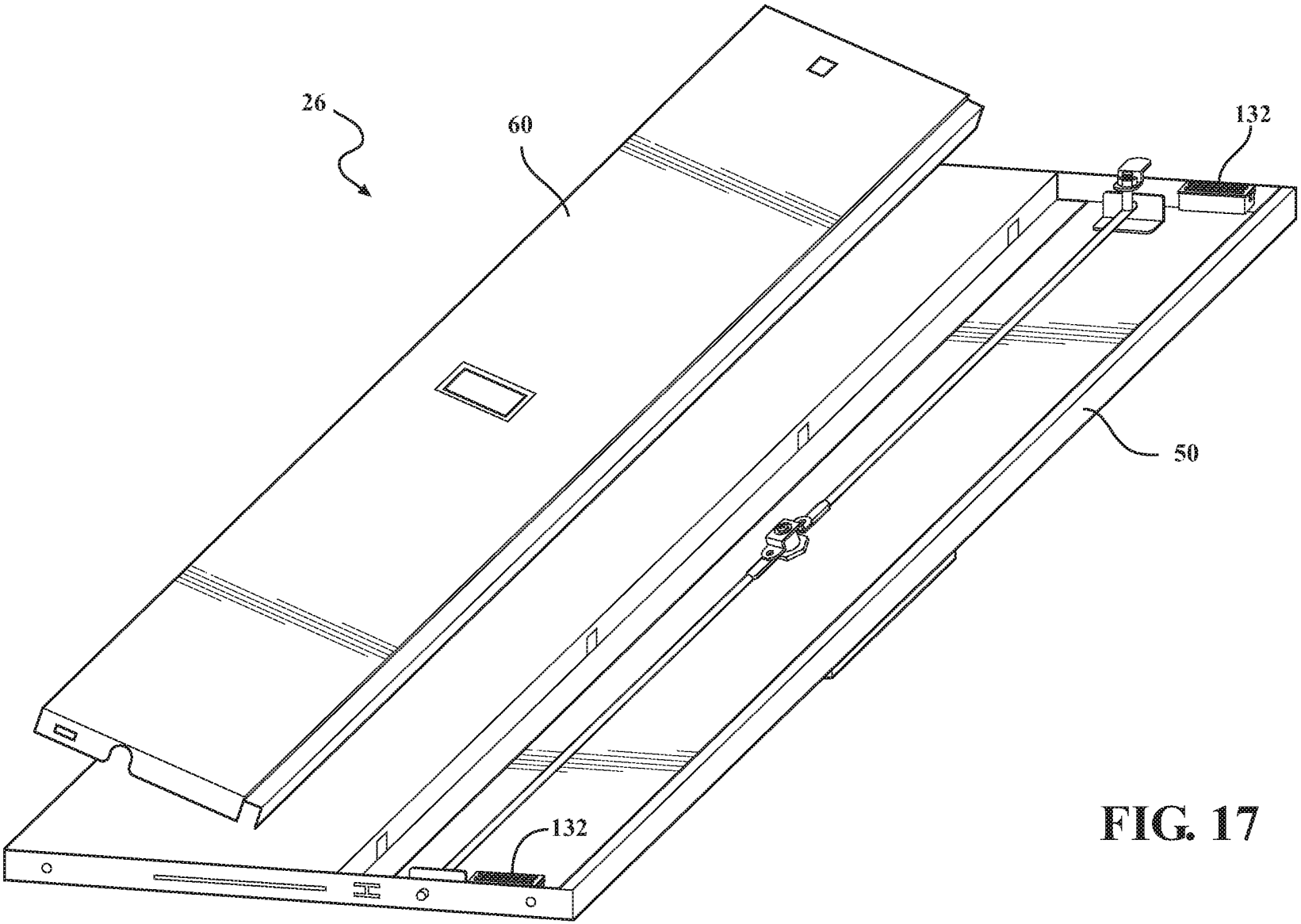

As shown in FIGS. 12, 14, and 17, in one embodiment, the door assembly 26 include a pair of magnets 132 coupled to the inner surface 55 of the outer panel. The snap-in cover panel 60 includes corresponding magnet slots that are sized and shaped to receive the magnets 132 therethrough to allow the magnets 132 contact the cabinet body 12 with the door assembly 26 in the closed position.

FIGS. 2 and 5-10 illustrate a method of assembling the door assembly 26 including the locking assembly 28. In method step 202, corresponding to the illustration shown in FIG. 5, the guide bushing 78 is coupled to the support bracket 80 mounted to the inner surface 55 of the outer panel, and the lock rod 74 is inserted through the guide bushing 78. In method step 204 (shown in FIG. 6), the washer 98 is positioned at the second end of the end cap 76 and around the support member 90. In method step 206 (corresponding to the illustrations shown in FIGS. 7 and 8), the snap-in cover panel 60 is positioned over the end cap 76 and lock rod 74 and coupled to the outer panel 52. In method step 208 (corresponding to the illustrations shown in FIGS. 9 and 10), the support flange 100 is coupled to the end cap 76 using the locking nut 106, spacer 108, and locking washer 110.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A cabinet assembly comprising:

a cabinet body comprising a back wall, a pair of opposing sidewalls coupled to said back wall, a top wall coupled to said back wall and each of said opposing sidewalls, and a bottom wall opposing said top wall and coupled to said back wall and each of said opposing sidewalls, wherein said back wall, said pair of opposing sidewalls, said top wall and said bottom wall define an interior volume of the cabinet assembly;

a door assembly pivotably coupled to one of said pair of opposing sidewalls of said cabinet body and moveable between an open and a closed position, said door assembly comprising:

an outer panel, and an inner panel spaced from said outer panel to define an interior door cavity therebetween, with said inner panel having a fixed panel and a cover panel;

a locking assembly at least partially contained within said interior door cavity, said locking assembly comprising:

a first lock rod disposed within said interior door cavity, a guide bushing including an opening for receiving said first lock rod, a support bracket coupled to an inner surface of said outer panel and having an opening to receive said guide bushing therethrough;

an end cap including an opening for receiving a distal end of said first lock rod;

a support member coupled to said end cap and extending through an elongated slot in said cover panel;

a latch coupled to said support member and extending outwardly from said outer surface of said inner panel and within said interior volume, a locking mechanism coupled to said first lock rod to selectively lock and unlock said door assembly to said cabinet body when said door assembly is in said closed position, said latch also configured to engage said flange when said locking mechanism is in said locked position to prevent movement of said door assembly from said closed position to said open position, wherein said cover panel is configured to allow said locking assembly to be assembled within said interior door cavity prior to the installation of said cover panel and is also configured to separate said interior door cavity from said interior volume of said cabinet assembly after installation of said cover panel.

2. The cabinet assembly of claim 1, wherein:

said support bracket includes a support flange oriented substantially perpendicular to said inner surface, and wherein said end cap includes a body extending between a first end and a second end, said second end including said opening for receiving said distal end of said first lock rod, and wherein said support member is oriented perpendicular to said inner surface of said outer panel.

3. The cabinet assembly of claim 1, wherein said first lock rod further includes a cotter pin inserted through a side opening in an outer surface of said second end of said end cap and through a side opening in said first lock rod.

4. The cabinet assembly of claim 1, wherein said latch comprises:

a support flange oriented substantially parallel with an outer surface of said cover panel, an L-shaped locking flange extending outwardly away from said support flange and said outer surface, said L-shaped locking flange including a planar locking surface positioned at a distance from said cover panel and oriented substantially parallel to said outer surface of said cover panel;

a threaded locking bolt inserted within an opening in said support flange and coupled within said threaded opening of said support member to secure said support flange to said support member.

5. The cabinet assembly of claim 4, wherein said outer surface of said cover panel includes a recessed portion sized and shaped to receive said support flange such that said support flange is substantially flush with said outer surface of said cover panel within said recessed portion.

6. The cabinet assembly of claim 1, wherein said locking assembly further comprises a second lock rod disposed within said interior door cavity and coupled to said locking mechanism, said second locking mechanism extending in a direction towards said bottom panel, said second lock rod comprising:

a second lock rod having a first end coupled to said locking mechanism and a distal end opposite said first end;

a guide bracket having a support flange portion coupled to an inner surface of said cover panel and a free flange portion extending outwardly away from said inner surface of said cover panel, said free flange portion including an opening;

a sleeve guide coupled within said opening of said free flange portion, said sleeve guide including a guide opening, with said second lock rod received through said guide opening wherein said distal end of said second lock rod extends through a positioning slot on said bottom panel of said cabinet body when said locking mechanism is in said locked position and said door assembly is in said closed position.

7. The cabinet assembly of claim 6, wherein said locking mechanism comprises:

a lock cylinder coupled to said outer panel, said lock cylinder rotatable through a 90° rotational angle to move the locking assembly between the locked position and the unlocked position;

a cam arm coupled to said lock cylinder and rotatable with said lock cylinder, said cam arm having a first end coupled to said first lock assembly and a second end opposite said first end coupled to said second lock assembly, wherein said cam arm is oriented along a longitudinal axis to position said distal end of said second lock rod outwardly through said positioning slot of said bottom panel in said locked position, and wherein said cam are also extends said latch to engage said flange when said locking mechanism is in said locked position to prevent movement of said door assembly from said closed position to said open position.

8. The cabinet assembly of claim 1, wherein said cabinet assembly further comprises at least one magnet coupled to an inner surface of said outer panel.

9. A cabinet assembly comprising:

a cabinet body comprising a back wall, a pair of opposing sidewalls coupled to said back wall, a top wall coupled to said back wall and each of said opposing sidewalls, and a bottom wall opposing said top wall and coupled to said back wall and each of said opposing sidewalls, wherein said back wall, said pair of opposing sidewalls, said top wall and said bottom wall define an interior volume of the cabinet assembly;

a door assembly pivotably coupled to one of said pair of opposing sidewalls of said cabinet body and moveable between an open and a closed position, said door assembly comprising:

an outer panel, and an inner panel spaced from said outer panel to define an interior door cavity therebetween, with said inner panel having a fixed panel and a cover panel;

a locking assembly at least partially contained within said interior door cavity, said locking assembly comprising:

a first lock rod having a distal end, said lock rod further including a peg extending outwardly perpendicular to the length of said first lock rod through an elongated slot in said cover panel, a guide bushing including an opening for receiving said first lock rod such that said guide bushing is between said distal end and said peg;

a latch coupled to said first lock rod and extending outwardly from said outer surface of said inner panel and within said interior volume, a locking mechanism coupled to said first lock rod to selectively lock and unlock said door assembly to said cabinet body when said door assembly is in said closed position, said latch also configured to engage said flange when said locking mechanism is in said locked position to prevent movement of said door assembly from said closed position to said open position, wherein said cover panel is configured to allow said locking assembly to be assembled within said interior door cavity prior to the installation of said cover panel and is also configured to separate said interior door cavity from said interior volume of said cabinet assembly after installation of said cover panel.

10. The cabinet assembly of claim 9, wherein said latch comprises:

a support flange oriented substantially parallel with an outer surface of said cover panel, said support flange including an opening that receive said peg therethrough, an L-shaped locking flange extending outwardly away from said support flange and said outer surface, said L-shaped locking flange including a planar locking surface positioned at a distance from said cover panel and oriented substantially parallel to said outer surface of said cover panel;

a locking nut coupled to a threaded end of said peg to secure said support flange to said peg.

11. The cabinet assembly of claim 10, wherein said outer surface of said cover panel includes a recessed portion sized and shaped to receive said support flange such that said support flange is substantially flush with said outer surface of said cover panel within said recessed portion.

12. A method for forming a cabinet assembly having a hidden locking assembly, said method comprising:

providing a cabinet body comprising a back wall, a pair of opposing sidewalls coupled to the back wall, a top wall coupled to the back wall and each of the opposing sidewalls, and a bottom wall opposing the top wall and coupled to the back wall and each of the opposing sidewalls, wherein the back wall, the pair of opposing sidewalls, the top wall and the bottom wall define an interior volume of the cabinet assembly;

pivotably coupling a door assembly to one of the pair of opposing sidewalls of the cabinet body, the door assembly moveable between an open position and a closed position and comprising a door body comprising an outer panel and an inner panel, the outer panel spaced from the inner panel to define an interior door cavity therebetween, the inner panel comprising a fixed panel coupled to the first side panel;

providing a locking assembly comprising a first lock rod, a latch, and a locking mechanism;

providing a guide bushing including an opening, a support bracket including a support flange and including an opening, an end cap including a body extending between a first end and a second end, and a support member;

coupling the support flange to an inner surface of the outer panel;

inserting the guide bushing within the opening in the support bracket;

disposing the first lock rod within the interior door cavity;

inserting the first lock rod through the opening in the guide bushing such that the distal end of the first lock rod is received within the opening of the end cap;

coupling the body and the support member to the first lock rod;

coupling the locking mechanism to the first lock rod, said coupled locking mechanism moveable between a locked position and an unlocked position;

installing a cover panel having an elongated slot between the fixed panel and the second side panel such that the support member partially extends through the elongated slot in the cover panel;

coupling the latch to the support member such that it extends outwardly from the outer surface of the inner panel and within the interior volume and such that it engages the flange when the locking mechanism is in the locked position to prevent movement of the door assembly from the closed position to the open position.

13. The method of claim 12;

wherein the support flange is oriented substantially perpendicular to the inner surface; and wherein the support member oriented perpendicular to the inner surface of the outer panel.

14. The method of claim 12 further comprising inserting a cotter pin through a side opening in an outer surface of the second end of the end cap and through a side opening in the first lock rod to secure the lock rod to the end cap.

15. The method of claim 12 wherein the step of coupling the latch to the first lock rod comprises:

providing a latch comprising:

a support flange oriented substantially parallel with an outer surface of the cover panel, an L-shaped locking flange extending outwardly away from the support flange and the outer surface, the L-shaped locking flange including a planar locking surface positioned at a distance from the cover panel and oriented substantially parallel to the outer surface of the cover panel;

a threaded locking bolt inserted within an opening in the support flange; and coupling the threaded locking bolt within the threaded opening of the support member to secure the support flange to the support member.

16. The method of claim 15, wherein the outer surface of the cover panel includes a recessed portion, and wherein the support flange is substantially flush with the outer surface of the cover panel within the recessed portion with the latch is coupled to the first lock rod.

17. A method for forming a cabinet assembly having a hidden locking assembly, said method comprising:

providing a cabinet body comprising a back wall, a pair of opposing sidewalls coupled to the back wall, a top wall coupled to the back wall and each of the opposing sidewalls, and a bottom wall opposing the top wall and coupled to the back wall and each of the opposing sidewalls, wherein the back wall, the pair of opposing sidewalls, the top wall and the bottom wall define an interior volume of the cabinet assembly;

pivotably coupling a door assembly to one of the pair of opposing sidewalls of the cabinet body, the door assembly moveable between an open position and a closed position and comprising a door body comprising an outer panel and an inner panel, the outer panel spaced from the inner panel to define an interior door cavity therebetween, the inner panel comprising a fixed panel coupled to the first side panel;

providing a first lock rod having a distal end, the lock rod further including a peg extending outwardly perpendicular to the length of the first lock rod;

coupling the first end within an opening in a guide bushing such that the guide bushing is between the distal end and the peg;

providing a locking assembly comprising the first lock rod, a latch, and a locking mechanism;

disposing the first lock rod within the interior door cavity;

coupling the locking mechanism to the first lock rod, said coupled locking mechanism moveable between a locked position and an unlocked position;

installing a cover panel having an elongated slot between the fixed panel and the second side panel such that the peg extends through the elongated slot;

coupling the latch to the peg such that the latch extends outwardly from the outer surface of the inner panel and within the interior volume and such that the latch engages the flange when the locking mechanism is in the locked position to prevent movement of the door assembly from the closed position to the open position.

18. The method of claim 17, wherein the step of coupling the latch to the first lock rod comprises:

providing a latch comprising:

a support flange oriented substantially parallel with an outer surface of said cover panel, said support flange including an opening, an L-shaped locking flange extending outwardly away from said support flange and said outer surface, said L-shaped locking flange including a planar locking surface positioned at a distance from said cover panel and oriented substantially parallel to said outer surface of said cover pane, and a locking nut, coupling the peg through the opening in the support flange; and coupling the locking nut to the threaded end of the peg to secure the support flange to the peg.

19. A method for forming a cabinet assembly having a hidden locking assembly, said method comprising:

providing a cabinet body comprising a back wall, a pair of opposing sidewalls coupled to the back wall, a top wall coupled to the back wall and each of the opposing sidewalls, and a bottom wall opposing the top wall and coupled to the back wall and each of the opposing sidewalls, wherein the back wall, the pair of opposing sidewalls, the top wall and the bottom wall define an interior volume of the cabinet assembly;

pivotably coupling a door assembly to one of the pair of opposing sidewalls of the cabinet body, the door assembly moveable between an open position and a closed position and comprising a door body comprising an outer panel and an inner panel, the outer panel spaced from the inner panel to define an interior door cavity therebetween, the inner panel comprising a fixed panel coupled to the first side panel;

providing a locking assembly comprising a first lock rod, a second lock rod, a latch, and a locking mechanism;

providing a guide bushing including an opening, a support bracket including a support flange and including an opening, an end cap including a body extending between a first end and a second end, and a support member;

coupling the support flange to an inner surface of the outer panel;

inserting the guide bushing within the opening in the support bracket, disposing the first lock rod within the interior door cavity;

inserting the first lock rod through the opening in the guide bushing such that the distal end of the first lock rod is received within the opening of the end cap, coupling the body and the support member to the first lock rod;

providing a guide bracket including a support flange portion and a free flange portion, and a sleeve guide, coupling the sleeve guide within an opening on the free flange portion, coupling the second lock rod through a guide opening on the sleeve guide, disposing the second lock rod within the interior door cavity;

coupling the locking mechanism to the first lock rod and to the second lock rod such that the locking mechanism is between the first lock rod and the second lock rod, said coupled locking mechanism moveable between a locked position and an unlocked position, wherein a distal end of the second lock rod extends through a positioning slot on the bottom panel of the cabinet body when the locking mechanism is in the locked position and the door assembly is in the closed position;

installing a cover panel having an elongated slot between the fixed panel and the second side panel such that a portion of the first lock rod extends through the elongated slot;

coupling the latch to the first lock rod such that it extends outwardly from the outer surface of the inner panel and within the interior volume and such that it engages the flange when the locking mechanism is in the locked position to prevent movement of the door assembly from the closed position to the open position.

20. The method of claim 19, wherein the support flange is oriented substantially perpendicular to the inner surface, and wherein the support member oriented perpendicular to the inner surface of the outer panel.

* * * * *